United States Patent [19]

Bertails et al.

[11] 4,442,398

[45] Apr. 10, 1984

[54] INTEGRATED CIRCUIT GENERATOR IN CMOS TECHNOLOGY

[75] Inventors: Jean-Claude Bertails; Christian Perrin, both of Grenoble, France

[73] Assignee: Societe pour l'Etude et la Fabrication de Circuits Integres Speciaux-E.F.C.I.S., Grenoble, France

[21] Appl. No.: 319,791

[22] Filed: Nov. 9, 1981

[30] Foreign Application Priority Data

Nov. 14, 1980 [FR] France ..... 80 24232

[51] Int. Cl.[3] ..... G05F 3/20

[52] U.S. Cl. ..... 323/315; 307/297

[58] Field of Search ..... 307/297; 323/313, 314, 323/315

[56] References Cited

U.S. PATENT DOCUMENTS 4,327,321 4/1982 Suzuki et al. ..... 323/315
4,342,926 8/1982 Whatley ..... 323/315 X
4,361,797 11/1982 Kojima et al. ..... 307/297 X

FOREIGN PATENT DOCUMENTS 2826624 6/1978 Fed. Rep. of Germany .
2016801 3/1979 United Kingdom .

OTHER PUBLICATIONS

Electronic Design, vol. 26, No. 23, Nov. 1978, (U.S.A.), D. Bingham, "CMOS: Higher Speeds More Drive and Analog Capability Expand its Horizons", pp. 74–82.
IEEE Journal of Solid State Circuits, vol. SC-14, No. 3, Jun. 1979, New York.
G. Tzanateas et al.: "A CMOS Bandgap Voltage Reference", pp. 655–657.

*Primary Examiner*—William M. Shoop
*Attorney, Agent, or Firm*—Roland Plottel

[57] ABSTRACT

An integrated circuit constituting a current generator formed by CMOS technology comprises a first pair of similar transistors, one of which recopies the current of the other, subject to a proportionality factor; a second pair of similar transistors, one of which recopies the source voltage of the other; a third pair of similar transistors having different threshold voltages in contrast to the other pairs. A resistor is placed in series with one of the transistors of the third pair in order to compensate for the difference between the threshold voltages, an additional transistor being provided for recopying the current in one of the transistors aforementioned. The current thus produced is stable in time as well as independent of temperature and of the circuit supply voltage.

6 Claims, 2 Drawing Figures

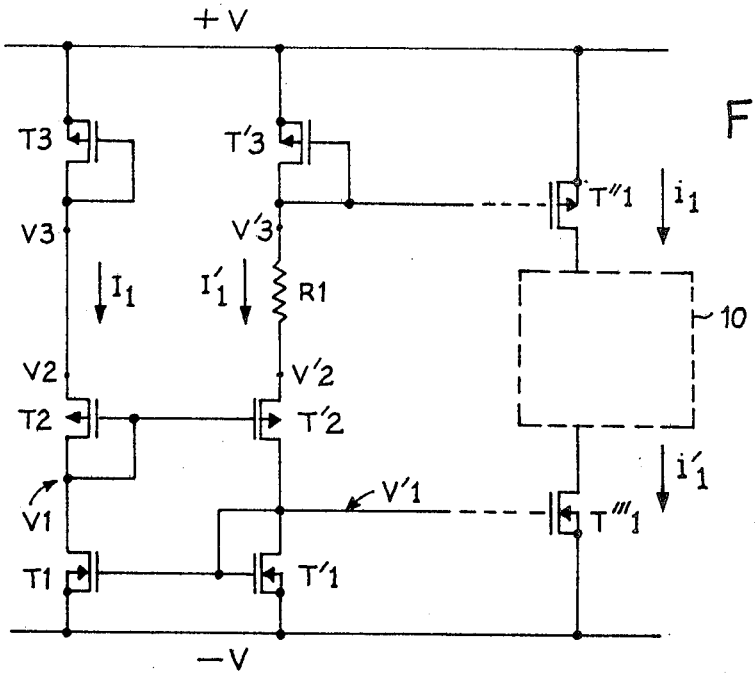
Fig. 1
Fig. 2
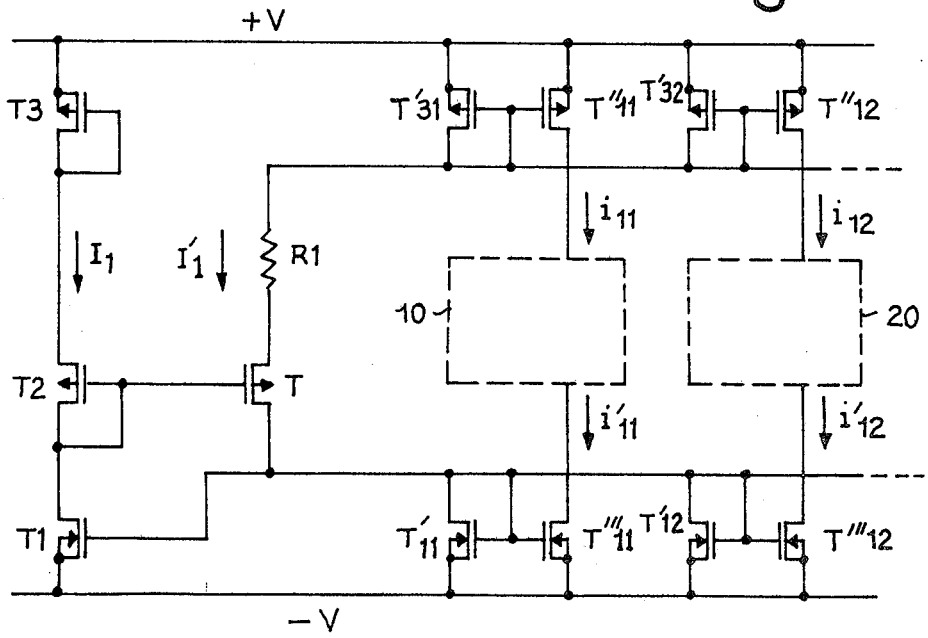

INTEGRATED CIRCUIT GENERATOR IN CMOS TECHNOLOGY

This invention relates to an integrated circuit which is capable of producing current sources of constant value, for example with a view to supplying current to the analog functions of an integrated circuit.

The fabrication process involved in this application is based on CMOS technology. In other words, the circuits constructed in accordance with this technology essentially comprise MOS transistors (metal-oxide-semi-conductor transistors) of the n-channel and of the p-channel type.

The aim of the invention is to produce current sources which have low dependence on the temperature and supply voltage of the integrated circuit in which provision is made for current sources of this type.

The guiding principle of the present invention is based on the fact that, in CMOS technology, it is a known practice to fabricate transistors having a threshold voltage which can be modified by ion implantation. This operation is performed during the successive steps of fabrication of the integrated circuit, with the result that predetermined transistors which are intended to have either a higher or a lower threshold voltage than others (in absolute value) can be designated by masking. The threshold voltage of these selected transistors can be adjusted to a desired value by producing action on the dose of implanted ions.

It has been demonstrated both in theory and by practical experience that the different threshold voltages of two transistors which have been subjected to a different ion implantation vary with the temperature but their difference does not vary.

The present invention proposes a particularly simple transistor circuit assembly for utilizing this property and obtaining from two transistors having different threshold voltages either one or a number of current sources which are temperature-independent and also independent of the supply voltage.

To this end, pairs of transistors operating in the saturating mode are employed, said transistors being interconnected in such a manner that one transistor can be caused to recopy the current or voltage conditions existing in another transistor until the difference between the threshold voltages of two transistors which have been subjected to a different ion implantation appears at the terminals of a resistor having a precise known value. The current which flows through said resistor is stable and steps are taken to ensure that said current passes through at least one MOS transistor which operates in the saturating mode and that said current is recopied (subject to a proportionality factor if so desired) by at least one other MOS transistor having the same gate-source bias voltage as the first transistor and the same threshold voltage.

In more precise terms, a particularly simple circuit assembly in accordance with the invention consists in providing a voltage source which supplies in parallel two similar assemblies of three transistors in series. Each transistor of one assembly corresponds to a similar transistor having the same channel type in the other assembly. The ratios between the geometries of two corresponding transistors are the same in the case of all the transistors of the assemblies. The first transistors of the assemblies have a first channel type; they have the same threshold voltage; their gates are connected to each other and, in addition, the gate of the transistor of the second assembly is connected to its drain. The second transistors of the opposite channel type have the same threshold voltage; their gates are connected to each other and, in addition, the gate of the transistor of the first assembly is connected to its drain. The third transistors of the opposite channel type have a gate connected in each case to the drain and have different threshold voltages (for example, in contrast to the other transistors of the same type, one of these transistors has not been subjected to ion implantation with a view to reducing its threshold voltage in absolute value or has alone been subjected to ion implantation in order to increase its threshold voltage in absolute value). A resistor which may or may not be integrated and has a known value is inserted in series between the second and third transistor of one of the assemblies. Finally, at least one separate MOS transistor is provided in addition to the two assemblies in order to serve as a constant and stable supply-current generator. The source and the gate of this transistor are connected to the source and to the gate of the first or third transistor of one of the assemblies. Said additional transistor has the same threshold voltage as the transistor to which it is connected in order to recopy the current which flows through this latter (subject to a known proportionality factor).

Provision may be made for a plurality of additional transistors, the gate and source of each transistor being connected to the gate and source respectively of the first or third transistor of one of the assemblies. Each additional transistor serves as a stable current source since it recopies the stable current in the resistor. The additional transistor or transistors have a known geometry factor with respect to the transistors to which they are connected. In consequence, a known ratio exists between the current recopied by said additional transistor or transistors and the stable current in the resistor.

In a more particular embodiment, each first or third transistor as well as each additional transistor can be "distributed" or in other words can constitute a plurality of partial individual transistors instead of a single transistor. All these transistors are connected in parallel (same gate, source and drain connection) and perform exactly the same function as a single transistor but can be located at a number of different points. Under these conditions, there can be placed side by side a first or a third partial transistor and an additional partial transistor which is associated therewith so as to constitute an individual stable current source which recopies the current in the resistor with a proportionality factor which depends on the geometry of said partial additional transistor.

The system of transistors in accordance with the invention ensures a stable current in the resistor by virtue of the fact that the voltage appearing at the terminals of this latter is the difference between the threshold voltages of two MOS transistors, only one of which has been subjected to an adjustment ion implantation. This voltage, and therefore the current which flows through the resistor, is dependent neither on the temperature nor on the supply voltage of the circuit and also exhibits high stability in time. The current produced within the resistor depends on the temperature to the same extent as the resistance and this latter is chosen so as to be as stable as possible, whether the resistor is integrated or external. In the case of an integrated resistor, it will be necessary to choose a diffused resistor having the lowest temperature coefficient.

In broad outline, it may be stated that the arrangement in accordance with the invention comprises a first pair of similar transistors, one of which recopies the current of the other transistor (subject to a proportionality factor), a second pair of similar transistors, one of which recopies the source voltage of the other transistor, a third pair of similar transistors although having different threshold voltages resulting in a voltage difference, a resistor in series with one of the transistors of the third pair in order to compensate for said voltage difference, and at least one additional transistor for recopying (subject to a proportionality factor) the current in one of the aforementioned transistors.

In the present invention, the feature of key importance lies in the correspondence of ratios of geometry factors of all the pairs of similar transistors and in the exact correspondence of threshold voltages of all the pairs of similar transistors with the exception of one pair which is precisely intended to generate a voltage difference. Steps must also be made to ensure that the threshold voltage of the additional current-recopy transistor or transistors is exactly the same as the threshold voltage of the transistor to which its gate and source are connected.

Other features of the invention will be more apparent upon consideration of the following description and accompanying drawings, wherein:

FIG. 1 is a detailed diagram illustrating one example of a circuit arrangement according to the invention;

FIG. 2 illustrates an example of an alternative circuit arrangement.

The circuit of FIG. 1 is therefore intended to produce a stable current source for supplying a portion 10 of an analog circuit which is in principle integrated on the same substrate as the current source according to the invention. By way of example, said analog circuit may be a portion of amplifier. In particular, many differential amplifiers utilize constant-current sources.

The assembly consisting of the integrated circuit (analog portion 10 and current source according to the invention) is supplied, for example, from symmetrical voltage levels +V and −V.

Two similar sets of three transistors each mounted in series and designated respectively by the references $T_1$, $T_2$, $T_3$ in the case of the first set and by the references $T'_1$, $T'_2$, $T'_3$ in the case of the second set are connected in parallel between the conductors for supplying current at +V and −V. The transistor $T_1$ is similar to the transistor $T'_1$, the transistor $T_2$ is similar to the transistor $T'_2$ and the transistor $T_3$ is similar to the transistor $T'_3$.

The transistors $T_1$ and $T'_1$ are of the n-channel type (for example); the transistors $T_2$, $T'_2$ and $T_3$, $T'_3$ are of the opposite channel type, namely p-type in the example chosen.

The transistors $T_1$, $T_2$ and $T_3$ can have any desired geometries, the transistors $T'_1$, $T'_2$ and $T'_3$ have geometries in the same ratio as the transistors $T_1$, $T_2$ and $T_3$. In other words, there exists a constant coefficient of proportionality between the similar transistors of the two assemblies in series.

Moreover, the similar transistors $T_1$ and $T'_1$ have the same threshold voltage; the similar transistors $T_2$ and $T'_2$ also have the same threshold voltage; on the other hand, the transistors $T_3$ and $T'_3$ have different threshold voltages designated respectively by the references $V_{T3}$ and $V'_{T3}$. For example, all the p-channel MOS transistors of the integrated circuit, and especially the transistors $T_2$, $T'_2$ and $T'_3$ have been subjected to ion implantation through their gate insulation in order to reduce their threshold voltage. On the contrary, the transistor $T_3$ has been masked during this operation and consequently retains a threshold voltage which is higher in absolute value than the transistor $T'_3$ and the other transistors.

In addition, a series resistor $R_1$ has been incorporated in the second series assembly $T'_1$, $T'_2$, $T'_3$ between the drain of the transistor $T'_2$ and the source of the transistor $T'_3$. It should be noted here that said resistor $R_1$ can be incorporated with the integrated circuit and can in that case be fabricated in the form of a portion of doped silicon. Alternatively, said resistor can be external to the circuit and connected to this latter by means of external lugs and metallized connections.

The drain of the transistor $T'_1$ is connected to its gate which is in turn connected to the gate of the transistor $T_1$ in accordance with a so-called "current mirror" arrangement of known type, with the result that the current within the transistor $T_1$ recopies the current within the transistor $T'_1$, subject to a proportionality factor which is the ratio K between the geometry of the transistor $T_1$ and the geometry of the transistor $T'_1$ (which is also the ratio between $T_2$ and $T'_2$ and the ratio between $T_3$ and $T'_3$).

This current recopy arises from the fact that the transistors $T_1$ and $T'_1$ have a common gate-source voltage and a common threshold voltage and that they operate in the saturating mode. In point of fact, in the saturating mode, the current is given by the formula $$I=k(Z/L)\,(V_{GS}-V_T)^2$$

where $V_{GS}$ is the gate-source voltage, $V_T$ is the threshold voltage,

Z/L is the geometry factor, k is a coefficient which depends on the technology employed (the technology is the same for all transistors of the integrated circuit).

In the case of a common voltage $V_{GS}$ and a common voltage $V_T$, it is apparent that the current $I_1$ within the transistor $T_1$ is in fact proportional to the current $I'_1$ within the transistor $T'_1$, the proportionality factor being the ratio of geometries of the two transistors.

The drain of the transistor $T_2$ is connected to its gate and this latter is in turn connected to the gate of the transistor $T'_2$, thus constituting another "current mirror" arrangement. In this case, however, the sources of the transistors $T_2$ and $T'_2$ are not connected to each other, with the result that the gate-source voltage of the transistors $T_2$ and $T'_2$ is not directly imposed. On the other hand, the current which flows through the transistor $T_2$ is the same as the current which flows through $T_1$ (current $I_1$) and the current which flows through the transistor $T'_2$ is the same as the current which flows through $T'_1$ (current $I'_1$).

Inasmuch as the currents within the transistors $T_2$ and $T'_2$ are imposed and the gate voltages are imposed, the current formula given in the foregoing makes it possible to calculate the gate-source voltages of the transistors $T_2$ and $T'_2$. These transistors in fact have the same threshold voltage; they have a ratio of geometries K and currents $I_1$ and $I'_1$ flow through said transistors precisely in a ratio $K(I_1=KI'_1)$. This means that their gate-source voltages will be the same. Inasmuch as said transistors have a common gate voltage, the voltages $V_2$ and $V'_2$ of their sources will consequently be identical without any direct connection between their sources.

Just as the transistor $T_1$ recopied the current within the transistor $T'_1$, so the transistor $T_2$ consequently recopies the source voltage of the transistor $T'_2$.

In regard to the transistors $T_3$ and $T'_3$, the sources of these latter are connected to the supply voltage $+V$ and their gates are preferably connected to their drains. By again applying the same formula for calculating the current in the saturating mode and by taking into account the fact that the currents $I_1$ and $I'_1$ which pass through the transistors $T_3$ and $T'_3$ are in the ratio K of geometries of the transistors $T_3$ and $T'_3$, it may immediately be deduced that there appears between the drains (that is to say the gates) of the transistors $T_3$ and $T'_3$ a voltage difference which is precisely equal to the difference in threshold voltages of these transistors. In other words, if $V_3$ is the drain voltage of the transistor $T_3$ and if $V'_3$ is the drain voltage of the transistor $T'_3$, then we have $V'_3-V_3=V'_{T3}-V_{T3}$. Since the drain of $T_3$ is connected to the source of $T_2$, we have $V_3=V_2$. Furthermore, since the resistor $R_1$ is inserted between the drain of the transistor $T'_3$ and the source of the transistor $T'_2$, we have $$V'_3-V'_2=R_1I'_1$$

Finally, since it has been stated that $V_2=V'_2$ by voltage recopy, it can immediately be deduced therefrom that the voltage drop $R_1 I'_1$ within the resistor $R_1$ is equal to the difference in threshold voltages of the transistors $T'_3$ and $T_3$. The current $I'_1$ is therefore a current having a well-determined value which is stable in time, stable in temperature, and independent of the supply voltage $+V$, $-V$.

It will further be noted that the current $I_1$ within the first series assembly of transistors $T_1$, $T_2$, $T_3$, is also a stable current since it recopies the current $I'_1$ subject to a proportionality factor which is the ratio K between the geometries of the transistors of the first and second series assembly. This ratio is of course independent of the temperature.

In order to establish a constant supply current $i_1$ within a portion of analog circuit 10, steps are accordingly taken to recopy the current $I_1$ or $I'_1$ with a conventional "current mirror" circuit arrangement. This is achieved by employing at least one additional transistor $T''_1$ and this latter is given a gate-source voltage equal to that of another transistor through which either the current $I_1$ or the current $I'_1$ passes; said transistor $T''_1$ has the same threshold voltage as the transistor whose gate-source voltage is to be recopied by $T''_1$. Under these conditions, the current $i_1$ within $T''_1$ will recopy the current $I_1$ or the current $I'_1$ with a proportionality factor which will be the ratio between the geometry of the transistor $T''_1$ and the transistor which will have the same gate-source voltage as this latter.

In the example shown in FIG. 1, it is proposed by way of example to connect the gate of the transistor $T''_1$ to the gate of the transistor $T'_3$, the sources of these two transistors being also connected to the supply conductor $V+$. The transistor $T''_1$ will have the same threshold voltage as the transistor $T'_3$. If the geometry ratio between the transistor $T''_1$ and the transistor $T'_3$ is $K'$, we will have $i_1=K' I'_1$.

The transistor $T''_1$ is then connected in series between the analog circuit 10 and the supply connection $V+$. A stable input current $i_1$ to the circuit 10 is thus produced.

As shown in FIG. 1, it is also possible to produce an output current $i'_1$ by connecting a recopy transistor $T'''_1$ in series between the supply connection $-V$ and the analog circuit 10. The output current $I'_1$ can quite easily be provided separately or in addition to the current $I_1$ and is not necessarily equal to the current $I_1$. The transistor $T'''_1$ recopies the current in the transistor $T'_1$ (or $T_1$) if its gate and its source are connected to the gate and to the source of the transistor $T'_1$ (or $T_1$).

If $K''$ is the ratio between the geometry of the transistor $T'''_1$ and the geometry of the transistor $T'_1$, and given the fact that these two transistors have the same threshold voltage, then the current $i'_1$ will be $K'' I'_1$.

It is worthy of note that another reference supply current could have been obtained from an additional transistor having a gate and a source connected to the gate and to the source of the transistor $T_3$ instead of the transistor $T'_3$. However, it would be necessary in such a case to ensure that the additional recopy transistor connected in this manner has a threshold voltage equal to that of the transistor $T_3$ which is not the same as the others.

FIG. 1 shows only a single analog circuit 10 which is supplied with an input current $i_1$ and delivers an output current $i'_1$. Provision can clearly be made for a number of analog circuits each supplied from a recopy transistor whose gate and source are connected to one of the transistors (in practice the transistors $T_1$, $T'_1$ and $T'_3$) through which the stable currents pass, namely either $I_1$ or $I'_1$.

It will be understood that the "current recopy" transistor mentioned throughout the foregoing description has the same channel type as the transistor to which its gate and its source are connected.

FIG. 2 shows a current supply circuit which is wholly similar to that of FIG. 1 and in which it is sought to supply a plurality of analog circuits 10, 20, and so on, in which each circuit calls for a stable individual reference current. If necessary, said circuits may be placed at different points of the entire integrated circuit wafer.

FIG. 2 shows precisely the first series assembly of three transistors $T_1$, $T_2$ and $T_3$ through which the current $I_1$ passes. There are again shown in this figure the series resistor $R_1$ through which the current $I'_1$ passes as well as the transistor $T'_2$ through which said current also passes. The difference between this figure and the diagram of FIG. 1 lies in the fact that the transistor $T'_3$ and/or the transistor $T'_1$ on the one hand as well as the transistor $T''_1$ and/or the transistor $T'''_1$ on the other hand are not designed in the form of single transistors but in the form of a plurality of partial individual transistors which are all connected in the same manner (same gate, source and drain connections), which perform exactly the same function as a single transistor but which can be located at a number of different points of the integrated circuit. Thus the transistor $T'_3$ is designed in the form of a plurality of transistors $T'_{31}$, $T'_{32}$ . . . etc. which are all connected in parallel. The transistor $T'_1$ is designed in the form of a plurality of transistors $T'_{11}$, $T'_{12}$ . . . , and so on. The transistor $T''_1$ is designed in the form of a plurality of transistors $T''_{11}$, $T''_{12}$ . . . and so on. Finally the transistor $T'''_1$ is designed in the form of a plurality of transistors $T'''_{11}$, $T'''_{12}$ . . . and so on.

Steps can also be taken to locate a partial transistor of the plurality constituting $T'_3$ next to a respective partial transistor of the plurality of the type $T''_1$. Similarly, a partial transistor of type $T'_1$ can be placed next to a transistor of the same type as $T'''_1$. Each of the transistors $T''_{11}$, $T''_{12}$, etc., or $T'''_{11}$, $T'''_{12}$ etc., recopies the current of a partial transistor $T'_{31}$, $T'_{32}$ . . . etc., or $T'_{11}$, $T'_{12}$ . . . etc.

As will readily be apparent, the resultant stable supply currents $i_{11}$, $i_{12}$ . . . or $i'_{11}$, $i'_{12}$ . . . are currents for recopying $I'_1$ in a proportionality ratio corresponding to the ratio of the geometry factors of the juxtaposed transistors which give rise to these recopy currents.

What is claimed is:

1. An integrated-circuit current generator formed by CMOS technology, wherein said current generator comprises a voltage source which supplies in parallel two similar assemblies of three MOS transistors in series, each transistor of one assembly being such as to correspond to a similar transistor having the same channel type in the other assembly and the geometry ratios of the similar transistors being the same in the case of all the transistors of the assemblies, the first transistors of a first channel type being such as to have a common threshold voltage and gates connected to each other, the gate of the transistor of the second assembly being also connected to its drain, the second transistors of the opposite channel type being such as to have a common threshold voltage and gates connected to each other, the gate of the transistor of the first assembly being also connected to its drain, the gates of the third transistors of the opposite channel type being connected to their drains and being such as to have different threshold voltages, a resistor of known value being inserted in series between the second and third transistor of one of said assemblies, at least one additional MOS transistor being provided in addition to said assemblies in order to serve as a constant supply-current generator, the source and the gate of said additional transistor being connected to the source and to the gate of the first or the third transistor of one of said assemblies, the threshold voltage of said additional transistor being the same as that of the transistor to which it is thus connected.

2. A current generator according to claim 1, wherein one of the third transistors has been subjected to ion implantation for increasing or reducing its threshold voltage in absolute value, the other third transistor having been masked during this operation.

3. A current generator according to claim 2, wherein all the transistors of the opposite channel type of the current generator have been subjected to said ion implantation with the exception of the third transistor which has been masked or conversely.

4. A current generator according to claim 1, wherein provision is made for a plurality of additional transistors, the gate and source of each additional transistor being connected to the gate and to the source of the first or the third transistor of one of the assemblies in order to produce a plurality of current references.

5. A current generator according to claim 1, wherein the additional transistors have geometries in known ratios which are chosen in relation to the geometries of the transistors to which they are connected.

6. A current generator according to claim 1, wherein the first and/or third transistor of the assembly including the series resistor are constituted by a plurality of MOS transistors which are mounted in parallel and connected in the same manner, and wherein the additional transistors are also constituted by a plurality of partial MOS transistors connected in the same manner, a partial additional transistor being associated with each first and/or third partial transistor in order to constitute an individual current source.

* * * * *